United States Patent [19]

North et al.

[11] Patent Number: 4,643,455

[45] Date of Patent: Feb. 17, 1987

[54] DETACHABLE BANK CARD TRANSACTION RECORDING DEVICE

[76] Inventors: Vaughn W. North, 2486 E. 10375 South; Larry J. North, 8577 Six Shooter Cir., both of Sandy, Utah 84092

[21] Appl. No.: 783,786

[22] Filed: Oct. 3, 1985

[51] Int. Cl.[4] ..... B42D 15/00; B42D 3/12; B41L 1/36; B41L 1/20

[52] U.S. Cl. ..... 283/81; 283/58; 282/23 R; 282/25; 281/31; 281/35

[58] Field of Search ..... 283/81, 58; 282/25, 282/23 R; 281/15 B, 20, 31, 34, 35, 48, 49; 40/380, 395

[56] References Cited

U.S. PATENT DOCUMENTS

| | | | |
|---|---|---|---|
| 3,147,028 | 9/1964 | Scully | 282/23 R |
| 3,671,059 | 6/1972 | Zeller | 283/58 |
| 3,861,718 | 1/1975 | Strus | 283/58 |
| 4,128,202 | 12/1978 | Buros | 283/58 |
| 4,488,737 | 12/1984 | Jacobs et al. | 281/31 |

*Primary Examiner*—Paul A. Bell
*Assistant Examiner*—Paul M. Heyrana, Sr.
*Attorney, Agent, or Firm*—Thorpe, North & Western

[57] ABSTRACT

A detachable transaction recording device for use with a bank card for making entries of various financial transactions. The device includes a recording card having a recording format for data entry. An attachment member is integrally formed with the recording card and is positioned along one side with a preformed hinge forming the point of juncture. A temporary, nontransferable adhesive is applied at one face of the attachment member to enable removable adherence of the device directly to the bank card.

5 Claims, 2 Drawing Figures

DETACHABLE BANK CARD TRANSACTION RECORDING DEVICE,

BACKGROUND OF THE INVENTION

1. Field of the Invention

This invention pertains to devices for enabling immediate record entry of financial transactions made by use of a credit card, automatic teller card or similar card (referred to collectively herein as bank card).

2. Prior Art

The convenience of using a bank card in financial transactions has been a major factor leading to its widespread public acceptance. The desire for convenience, however, has resulted in poor accountability of bank card transactions. Users frequently disregard proper record keeping because the convenience of the bank card develops habits of laziness. Transaction slips are frequently lost or simply thrown away.

Various methods have been developed to encourage a more careful practice of record keeping; however, none have developed sufficient simplicity and ease to encourage public acceptance. Instead, users continue to bear the frustration of overdrawn accounts or forgotten transactions.

OBJECTS AND SUMMARY OF THE INVENTION

It is therefore an object of this invention to provide a transaction entry device which is automatically carried as part of the bank card and is simple to use.

It is a further object to provide a card which is releasably attached to the bank card, to be carried together in a standard size bank card pocket.

It is an additional object to provide a recording device which folds to protect the magnetic tape and user signature typically carried on the face of the bank card.

These and other objects are realized in a detachable device for recording financial transactions with respect to a bank card. The device comprises a recording card having a transaction record format on one side and including locations for entry of data. An attachment member is integrally formed with the recording card and is positioned along one side with a preformed hinge forming the point of juncture. A temporary, nontransferable adhesive means is applied at one face of the attachment member to enable removable adherence to the bank card. Accordingly, the device provides a recording card which is removably attached to the bank card, and which can be repeatedly separated and reattached to faciliate entry of data during each transaction.

Other objects and features of the present invention will be apparent to those skilled in the art based upon the following detailed description, taken with the accompanying drawings.

DETAILED DESCRIPTION OF THE INVENTION

Figure 1:
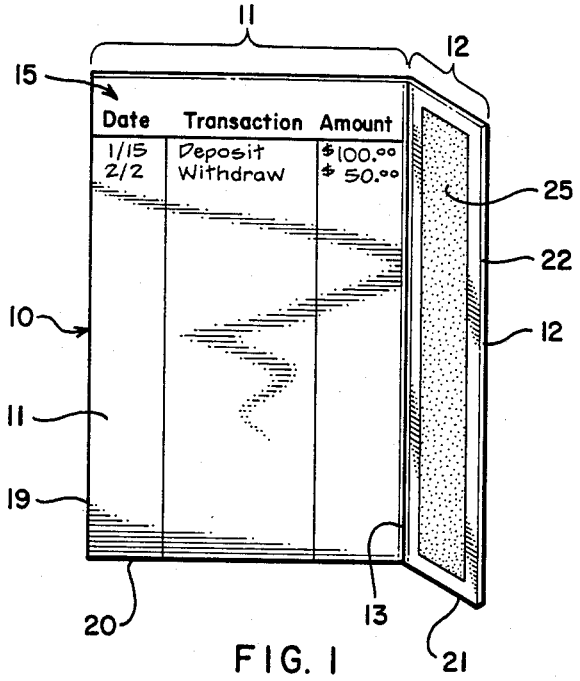
FIG. 1 is a perspective view of the transaction data entry device of the present invention.
Figure 2:
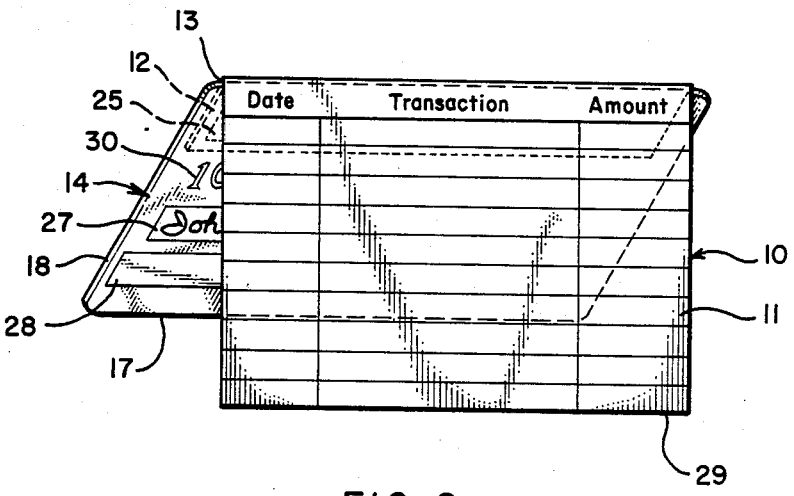
FIG. 2 is a perspective view of the device attached to a bank card.

A preferred embodiment of the present invention is illustrated in the drawings as item 10. It includes a recording card 11 which is coupled to an attachment member 12 by means of a hinge 13. As noted in FIG. 2, this construction permits the device to be folded around a bank card 14 and carried by the user in a wallet pocket or other card carrying case.

The recording card includes a transaction record format 15 for organizing entries relating to a particular financial transaction. The illustrated format includes a date column, transaction column and column for entry of dollar amount.

The specific format selected will depend upon the intended use of the card and nature of the financial account to which the bank card pertains.

The dimensions of the recording card are selected to match the dimensions of the bank card to which it is attached. Because bank cards have a standardized rectangular size of 8.5 cm along the long side 17 and by 5.4 cm along the short side 18, the preferred recording card 11 would have the same dimensions or less. These equal or smaller dimensions enable the stiff bank card to protect the recording card from being bent or otherwise deformed.

The attachment member 12 is integrally formed as part of the recording card 11. In the preferred embodiment, both parts are constructed of lightweight cardboard or heavy paper stock which is cut to a total dimension equal to the length of the recording card 19 and the combined widths 20 and 21 of the card and attachment member. The hinge 13 is formed by scoring the stock with an indentation parallel with the long side 19 to perform the bending location. The device is therefore adapted to bend or fold around the bank card 17 without taking any significant additional space when stored in a wallet pocket.

One face 22 of the attachment member 12 is provided with a nontransferring form of adhesive 25 which permits repeated detachment and reapplication to a contacting surface. This adhesive is permanently applied as part of the device but allows temporary adhesion to the bank card, which is typically made of plastic. When the attachment member is separated from the bank card, the adhesive is not transferred but remains intact on the face 12. Accordingly, this material is referred to as nontransferring, temporary adhesive, meaning that the bank card or other attached material is not rendered tacky when the contacting adhesive is removed. Such adhesive materials are commercially available from 3M.

The present invention directly to the bank card and actually becomes part of it. The only time the device is separated is when the bank card is inserted into an automatic teller machine. If the device is used in connection with a credit card, typical credit card number impression devices do not even require removal from the card to complete the transaction.

Because the recording card is part of the bank card and is automatically taken in hand with each transaction, identifying data regarding the transaction can easily be entered. Consequently, the user develops a sequential record of all transactions relating to the attached bank card. These can be used to verify reconciliation statements from the supporting bank.

In addition to matching the convenience of bank card use, the present invention provides additional benefits. For example, the folded configuration illustrated in FIG. 2 protects the users signature 27 and the magnetic tape 28. Likewise, the plastic bank card operates to protect the entries recorded on the recording card which are placed on the side 29 closest to the sensitive areas 27 and 28 of the bank card.

The figures disclose an embodiment which is adapted for attachment along the long side 17 of the bank card. This location is particularly suitable because it offers several significant benefits. This location allows the device to be attached without covering the numerals 30 which project on the concealed face of the bank card in FIG. 2. This improves the adhesive contact with the card and also permits the card to be used within an impression device without removal of the device. The positioning of the card along the direction of longitudinal insertion into a pocket also prevents the attachment member from being caught on another card being inserted in the same pocket. Although this point of attachment is preferred, the short side may also be the situs of attachment where circumstances dictate.

It is to be understood that the illustrations provided herein are exemplary and are not to be construed as limiting except in accordance with the following claims.

We claim:

1. A detachable device for recording financial transactions with respect to a particular bank card of predetermined dimension and being adapted to be continuously carried therewith by a user, said device comprising:

a recording card having a transaction record format on one side including locations for entry of data with respect to financial transactions conducted in connection with the bank card, said recording card having dimensions no greater than said predetermined dimensions of the bank card, said recording card being rectangular in planar configuration and having a long side and a short side;

an attachment member integrally formed with and along one side of the recording card and having a preformed hinge at the juncture of the attachment member with the recording card to thereby enable the attachment member to be folded against the recording card and to retain dimensions when so folded which are approximately equal to or less than the bank card, said attachment member being approximately equal or less in length to the length of the long side of the bank card;

temporary, nontransferable adhesive means applied at one face of the attachment member to enable removable adherence of the attachment member and coupled record card to a face of the bank card along one side thereof.

2. A device as defined in claim 1 wherein the adhesive means provides a reusable adhesive face to the attachment member to enable repeated separation and reattachment of the attachment member to the bank card.

3. A device as defined in claim 1 wherein the recording card and attachment member are formed of a single piece of paper stock in rectangular shape, said hinge comprising a scored indentation along one side of the paper stock to define the juncture of the attachment member and the recording card.

4. A device as defined in claim 1, wherein the hinge is positioned along the long side of the recording card, adapting the attachment member for adhesion along the long side of the bank card.

5. A device as defined in claim 1, wherein the hinge is positioned along the short side of the recording card, adapting the attachment member for adhesion along the short side of the bank card.

* * * * *